US007023682B2

(12) United States Patent
Dovheim

(10) Patent No.: US 7,023,682 B2
(45) Date of Patent: Apr. 4, 2006

(54) SOLENOID CONTROL USING VOLTAGE CONTROL OF FREEWHEEL CURRENT DECAY

(75) Inventor: Thomas Dovheim, Säffle (SE)

(73) Assignee: General Electric Company, Schenectady, NY (US)

( * ) Notice: Subject to any disclaimer, the term of this patent is extended or adjusted under 35 U.S.C. 154(b) by 184 days.

(21) Appl. No.: 10/756,442

(22) Filed: Jan. 12, 2004

(65) Prior Publication Data

US 2004/0201945 A1 Oct. 14, 2004

Related U.S. Application Data

(63) Continuation of application No. PCT/SE02/01183, filed on Jun. 19, 2002.

(60) Provisional application No. 60/304,872, filed on Jul. 12, 2001.

(30) Foreign Application Priority Data

Dec. 21, 2001 (SE) ..... 0104409

(51) Int. Cl.
*H01H 9/00* (2006.01)

(52) U.S. Cl. ..... 361/160

(58) Field of Classification Search ..... 361/160; 327/110, 170; 123/490
See application file for complete search history.

(56) References Cited

U.S. PATENT DOCUMENTS

| | | | | |
|---|---|---|---|---|
| 4,949,215 | A * | 8/1990 | Studtmann et al. | 361/154 |
| 5,574,617 | A * | 11/1996 | Shimanuki et al. | 361/154 |
| 5,975,057 | A * | 11/1999 | Repplinger et al. | 123/490 |
| 6,262,874 | B1 * | 7/2001 | Stoll et al. | 361/160 |
| 6,390,082 | B1 * | 5/2002 | Duffy et al. | 123/682 |
| 6,772,737 | B1 * | 8/2004 | Gaessler et al. | 123/490 |

* cited by examiner

*Primary Examiner*—Brian Sircus
*Assistant Examiner*—Boris Benenson
(74) *Attorney, Agent, or Firm*—Jeffrey Pearce

(57) ABSTRACT

In a vehicle fuel-injection system, additional voltage is applied to an otherwise current-controlled valve solenoid so as to increase the time window over which freewheeling current in the solenoid decreases from a pull-in level to a hold level. The time during which the Beginning of Injection Pulse (BIP) signal is detected is thereby increased.

10 Claims, 3 Drawing Sheets

SOLENOID CONTROL USING VOLTAGE CONTROL OF FREEWHEEL CURRENT DECAY

CROSS-REFERENCE TO RELATED APPLICATIONS

This application is a continuation of and claims priority of PCT/SE02/01183, filed 19 Jun. 2002, as well as of both Swedish Patent Application No. 0104409-8, filed 21 Dec. 2001, and U.S. Provisional Patent Application No. 60/304,872, filed 12 Jul. 2001, both of which PCT/SE02/01183 also claims priority from.

BACKGROUND OF THE INVENTION

1. Field of the Invention

This invention relates to solenoid control, especially in the context of solenoid-controlled fuel injection systems in vehicle engines.

2. Background Art

In order to minimize the exhaust of particles and nitrous oxide (NOx), as well as to achieve the highest possible efficiency in a diesel engine, the crank angle position at which fuel-injection into a cylinder of a vehicle engine is initiated is critical. Because such fuel injection is typically controlled by a solenoid valve, it is not enough to ensure that the control signal occurs at the correct position; rather one must also know when the valve itself has reached its fully opened position. One known method for determining this involves measuring the current in the driving stage of the solenoid and therefrom detecting the change in inductance that arises when the valve cone is seated.

This method is usually referred to as BIP-detection, where BIP stands for "Beginning of Injection Pulse." FIG. 1 is a diagram of current and voltage as functions of time as used in the conventional BIP technique. In principle, the solenoid is controlled by applying a voltage pulse U until the current in the solenoid winding reaches a predetermined level known as the "pull-in" current, which is the current level that must be achieved in the circuit in order to be able to move the solenoid armature.

Thereafter, the control voltage U is pulsed so that the winding current remains approximately at this level until the valve is fully opened. Once the valve is fully open, however, a significantly lower current—the so-called "hold" current—is needed in order to keep the valve open. This hold current is also maintained by pulsing the control voltage U. The hold current is maintained until it is once again time to close the valve, which is determined by the amount of fuel that is to be injected.

Detecting the BIP signal at the same time as the pull-in current is being regulated is very difficult because the BIP signal is typically obscured by the noise that arises when using such pure current regulation. The application of the pull-in current is therefore usually turned off immediately before the time when the BIP signal is expected to arise, which can be estimated using known methods. The BIP signal (which appears as a "bump" in the current curve) then occurs in the period during which the current discharges through a freewheel diode D connected to the solenoid winding. This period of current "decay" is known as the BIP "window." The minimum width of the BIP window needed for reliable detection of the BIP using standard equipment is typically about 600 μs.

"Freewheeling" refers to the remaining current that circulates within the solenoid circuit after the applied voltage has been shut off. If there were no resistive losses in this circuit, the freewheeling could theoretically continue forever. Components such as a freewheeling diode D and at least one resistive shunt are usually included in the solenoid circuitry, however. It has, moreover, also been shown that the time it takes for the solenoid current to decrease from the pull-in level to the hold level can vary greatly in practice, primarily because of resistances in the network of conductors (such as cables) and connectors used to connect the various components in the circuitry involved in operating the solenoid. These conductor resistances vary not only from application to application, but even among different valves in the same engine. The time for BIP detection may therefore be too short, such that it may become impossible to detect the occurrence of the BIP with certainty—the BIP pulse may fall outside the BIP window and disappear in the noise created by the current regulation.

The main components of a typical prior art circuit that implements current-only control are shown in FIG. 3. The injection solenoid S (represented in the figures as its inductive winding) is usually connected to a system power supply V via a resistive shunt Rs, in parallel with a freewheel diode D. A conventional circuit 100 is included to measure current through the solenoid, the result of which is applied to a differencing component (shown as an operational amplifier 202) in a current-regulating circuit 200.

Usually, this circuit 200 will have two inputs, namely, one to set the desired current level and another to turn the current on and off completely. The difference between measured current and desired current is then "added" into the circuit using a power transistor Q1. The On/Off signal is similarly applied via a corresponding transistor Q2, which acts essentially as a switch.

The source of the input signals for current level and current ON/OFF will typically be a supervisory processor that calculates desired values and times and generates the input signals in digital form, which are the converted into analog form using a conventional digital-to-analog converter.

The reason that the voltage U to the solenoid circuit is pulsed ON/OFF in the prior art, instead of being controlled over a continuous range is that the power that develops in the control electronics becomes too high. The problem to be solved is therefore how to ensure a sufficiently large BIP window, thereby allowing reliable BIP detection, without too much power being developed in the circuitry. One known attempted solution to this problem is to include additional circuitry that adds voltage directly to the freewheeling circuit. The difficulties and complications associated with this solution are well known.

SUMMARY OF THE INVENTION

A circuit arrangement for controlling a solenoid, which actuates a valve in a fuel-injection system, in which the solenoid is connected in parallel with a freewheel element, comprises a current-control circuit operable to switch current through the solenoid between a pull-in level and a hold level. A voltage-control circuit applies a continuously adjustable voltage at a connection point between the solenoid and the current-control circuit such that the time it takes the current through the solenoid to drop from the pull-in level to the hold level is adjustable above a minimum time.

In an illustrated embodiment of the invention, the current-control circuit includes an output transistor; the solenoid is connected to ground over the output transistor of the current-control circuit; and the connection point is electrically connected to an output point of the output transistor.

A current-measuring circuit is preferably also included such that it has an output signal indicating the current through the solenoid. The current-measuring circuit includes a resistive shunt connected electrically in series with the solenoid.

In the illustrated embodiment, the output signal of the current-measuring circuit forms a first input to a differencing element in the current-control circuit; a desired current level signal forms a second input to the differencing element in the current-control circuit; and the output of the differencing element in the current-control circuit corresponds to the difference between its first and second inputs and is applied as a driving input to the output element of the current-control circuit. Similarly, the voltage-control circuit includes an output transistor over which the solenoid is also connected to ground. An output signal of the voltage-measuring circuit, which is also the signal applied at the connection point, then forms a first input to a differencing element in the voltage-control circuit; a desired voltage level signal forms a second input to the differencing element in the voltage-control circuit; and the output of the differencing element in the voltage-control circuit corresponds to the difference between its first and second inputs and is applied as a driving input to the output element of the voltage-control circuit.

DETAILED DESCRIPTION

Figure 2:
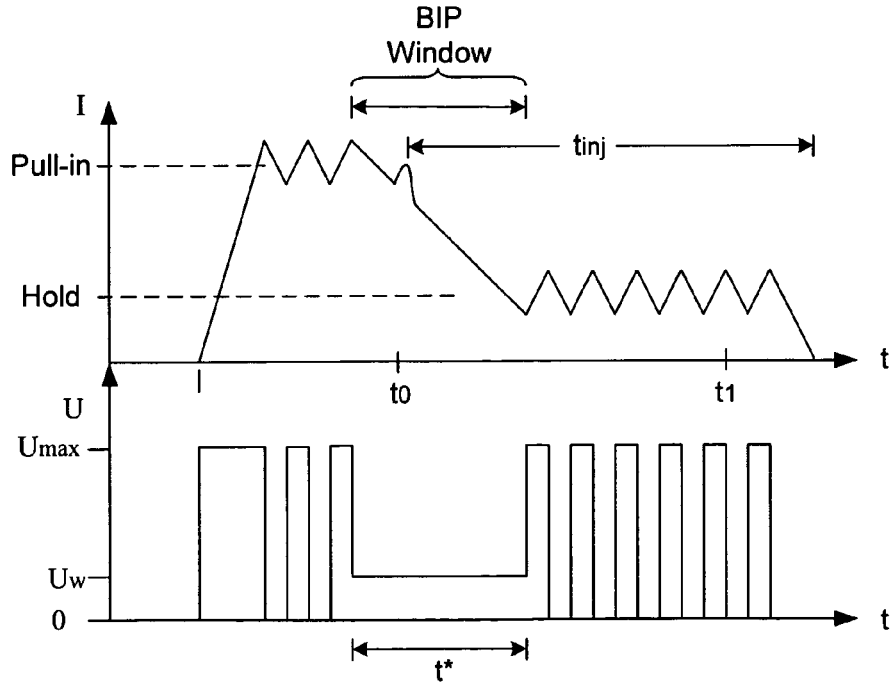
FIG. 2 illustrates the current and voltage sequence used to control the solenoid using the invention.
Figure 3:
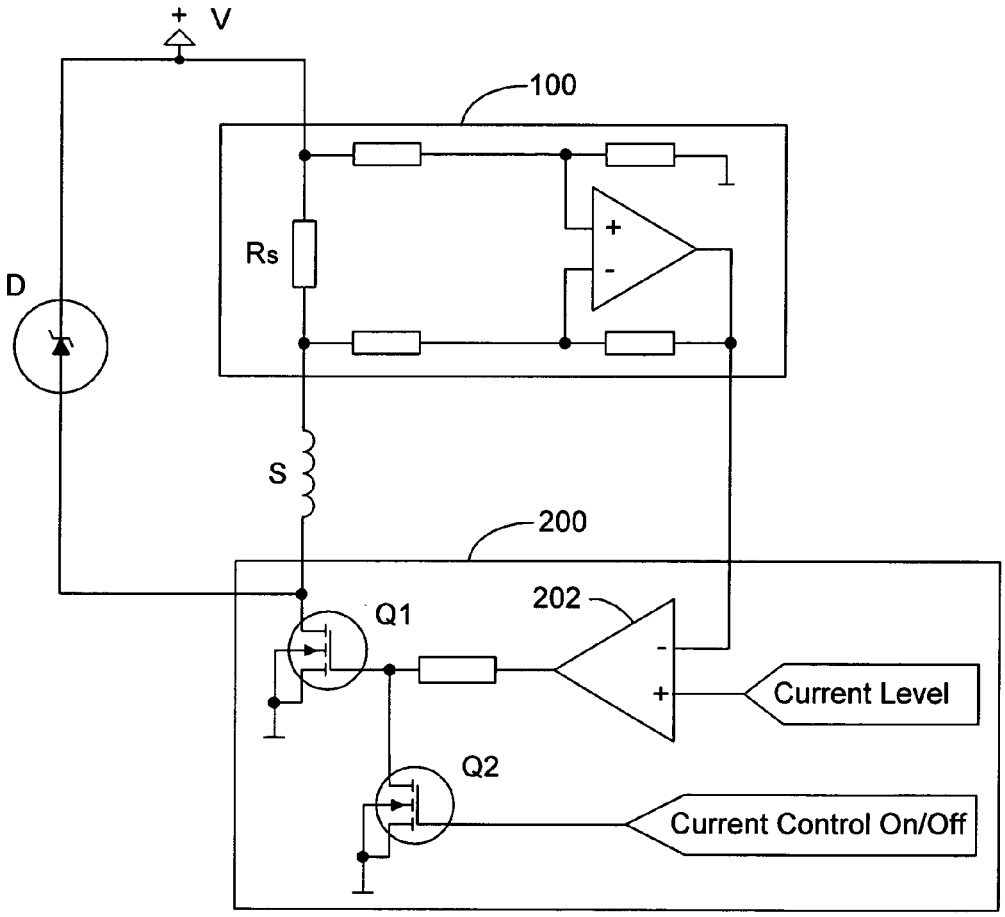
FIG. 3 (Prior Art)
FIG. 3 shows the main components of a circuit for regulating current to control the solenoid in the prior art.
Figure 4:
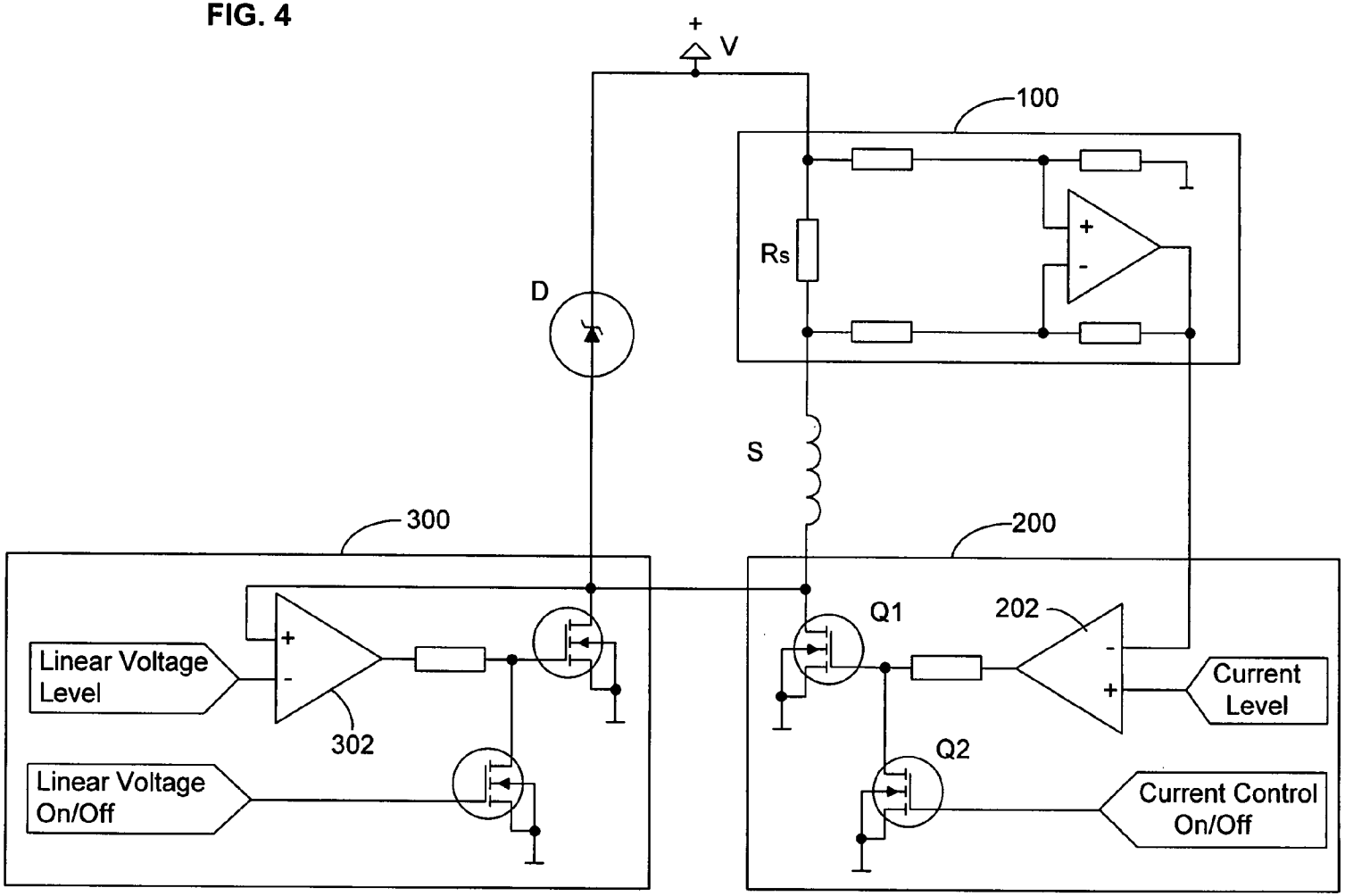
FIG. 4 shows the main components of a circuit for regulating current to control the solenoid according to the invention.

FIGS. 2 and 4 illustrate the main idea, and circuit, respectively, of the invention: Instead of simply pulsing the control voltage U either ON (Umax) or OFF (0) using the current control circuit 200, additional voltage Uw that may lie and vary anywhere between Umax and 0, inclusive, is added into the solenoid circuit at the beginning of and maintained during the BIP window by a voltage-control circuit 300.

As FIG. 4 shows, the voltage-control circuit 300 has a structure similar to that of the current control circuit 200, but taps the solenoid circuit directly (at the connection of the freewheeling diode D and the solenoid) as an input to the differencing component 302.

The input signals to the control circuit 300 are then the desired voltage level and voltage On/Off, which may also be generated by existing supervisory processing circuitry.

Figure 1:
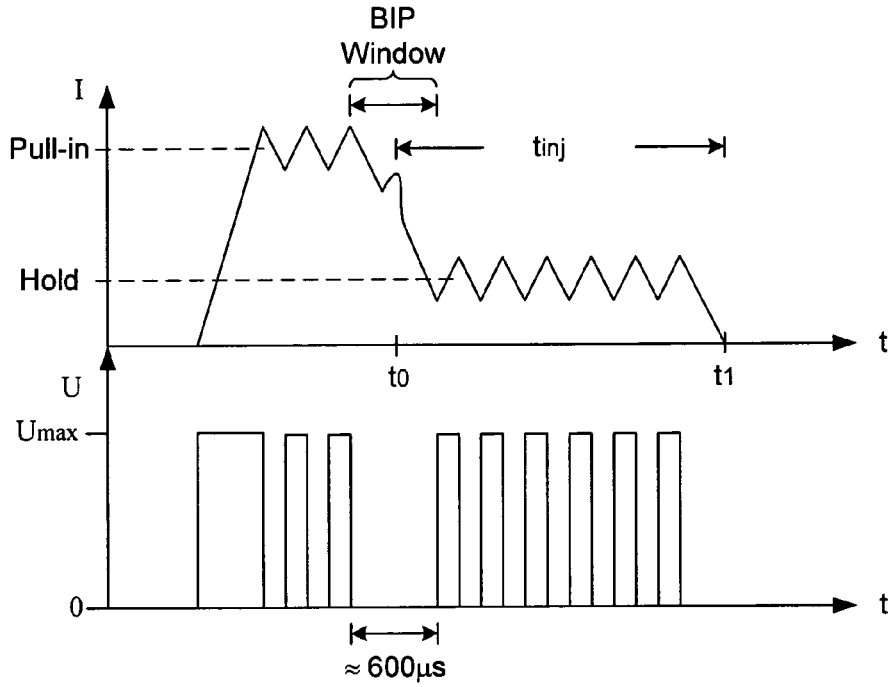
FIG. 1 (Prior Art)
FIG. 1 illustrates the current and voltage sequence used to control a solenoid in a fuel-injection system according to the prior art.

The "window voltage" Uw is shown in FIG. 2 as being a constant voltage only by way of example. As will become clearer from the description below, the voltage control circuit may be used to generate any voltage profile during the BIP window. A constant additional voltage Uw, will, however, usually be sufficient to adjust the duration of the BIP window. The regulation of the current in the transition range between pull-in and hold is referred to here as "linear" regulation. In this context, linear regulation means that the voltage applied by the voltage-regulating circuit 300 according to the invention may take any value between 0 and the maximum supply voltage. This contrasts with the conventional ON/OFF (switched) regulation used it the prior art, which is illustrated in FIG. 1.

As FIG. 2 shows, applying the window voltage across the solenoid after the pull-in current has been shut off allows the circuit to control the rate at which the current decreases substantially arbitrarily. Because this added current during the BIP window may be controlled smoothly, there is no concern that the BIP pulse itself will disappear in the noise created by the regulation of the current. Furthermore, although the power developed in the control electronics may become relatively high during the phase of linear regulation, it will be so only briefly, so that the average power developed will still be low.

In order to ensure the ability to detect BIP with respect to all external circuits, there should be a certain minimum width of the BIP window. FIG. 2 illustrates how the invention solves this problem using voltage-controlled linear regulation. One effect of the application of the invention is apparent from FIG. 2, namely, the BIP window is lengthened. The voltage level that is applied during the current decay period (the BIP window) may also be determined in such a way that the time it takes for the current to decrease from the pull-in level to the hold level remains essentially constant, regardless of the resistances within the network of conductor or other factors that might otherwise affect it.

As is mentioned above, if there were no resistive losses in the solenoid circuit, freewheeling could theoretically continue forever. In order to compensate for the voltage drop caused by the free-wheel current, multiplied by the inherent resistances, the invention thus makes it possible to add volts to the circuit.

Note that the figures principally show the principle of regulation—in actual implementation, both of the control circuits 200, 300 may share the same power transistors and do not necessarily need separate ones. In such case, only a few small and simple components will be needed, which makes for a compact and inexpensive solution.

The voltage regulation according to the invention is shown here relative to ground. In those cases where the supply voltage varies greatly, however, the regulation preferably takes place relative to the supply voltage instead.

There are several main advantages of the invention: It ensures that one, using existing equipment, may determine with certainty when the solenoid core is being moved; in other words, one can determine exactly when fuel injection begins in a cylinder. This solution according to the invention means that one may in all cases achieve a well-defined window within which to detect the BIP substantially free of interference.

Movement of the solenoid armature may then be detected accurately by the "bump" on the current curve, which is easy to detect using known techniques given the time made available by the invention for detection. This is in turn a prerequisite for exactly controlling and regulating a motor in order to minimize exhaust. The invention thus makes it possible to exactly control and regulate the fuel-injection time in a simple and cost-effective manner. The invention also makes it possible to allow greater resistances within the freewheel circuit, which means in turn that one can use cables of smaller gauge, which are less expensive.

What is claimed is:

1. A method for solenoid control comprising the following steps:

providing a freewheel circuit that includes a solenoid connected to a system power supply via a resistive shunt and a freewheel diode in parallel with the solenoid, the resistive shunt being included in a current-measuring circuit that measures current through the solenoid;

providing a current-control circuit comprising a differencing component, a power transistor and a switch device;

supplying a voltage pulse to the freewheel circuit by means of said power supply to reach a predetermined current level in said solenoid, and thereafter:

supplying pulsed voltage to said freewheel circuit by means of said current regulating circuit;

applying a measured result from the current-measuring circuit to the differencing component and thereby maintaining the supply by means of the current-regulating circuit for a certain time based upon the result of the measured result;

providing a voltage-control circuit comprising a second differencing component and having a structure similar to that of the current-control circuit;

connecting an input of the second differencing component to an output of the current control circuit;

applying into the freewheel circuit by means of the voltage-control circuit a control voltage of any value between 0 and a maximum supply voltage, thereby controlling the rate at which the current within the freewheel circuit decreases.

2. Method according to claim 1, further comprising detecting an irregularity in the decrease of the current in the solenoid during the controlled decrease of current and thereby determining when a core of the solenoid is being moved.

3. Method according to claim 2, in which the solenoid core moves a solenoid valve for fuel injection in a vehicle engine.

4. A circuit arrangement for controlling a solenoid that actuates a valve in a fuel-injection system, in which the solenoid is connected in parallel with a freewheel element comprising:

a current-control circuit operable to switch current through the solenoid between a pull-in level and a hold level; and a voltage-control circuit applying a continuously adjustable voltage at a connection point between the solenoid and the current-control circuit such that the time it takes the current through the solenoid to drop from the pull-in level to the hold level is adjustable above a minimum time.

5. An arrangement as in claim 4, in which:

the current-control circuit includes an output transistor;

the solenoid is connected to ground over the output transistor of the current-control circuit; and the connection point is electrically connected to an output point of the output transistor.

6. An arrangement as in claim 5, further comprising a current-measuring circuit having an output signal indicating the current through the solenoid, the current-measuring circuit including a resistive shunt connected electrically in series with the solenoid.

7. An arrangement as in claim 6, in which:

the output signal of the current-measuring circuit forms a first input to a differencing element in the current-control circuit;

a desired current level signal forms a second input to the differencing element in the current-control circuit;

the output of the differencing element in the current-control circuit corresponds to the difference between its first and second inputs and is applied as a driving input to the output element of the current-control circuit.

8. An arrangement as in claim 7, in which:

the voltage-control circuit includes an output transistor;

the solenoid is connected to ground over the output transistor of the voltage-control circuit.

9. An arrangement as in claim 8, in which:

an output signal of the voltage-measuring circuit, which is also the signal applied at the connection point, forms a first input to a differencing element in the voltage-control circuit;

a desired voltage level signal forms a second input to the differencing element in the voltage-control circuit;

the output of the differencing element in the voltage-control circuit corresponds to the difference between its first and second inputs and is applied as a driving input to the output element of the voltage-control circuit.

10. A circuit arrangement for controlling a solenoid that actuates a valve in a fuel-injection system, in which the solenoid is connected in parallel with a freewheel element comprising:

a current-control circuit operable to switch current through the solenoid between a pull-in level and a hold level;

a current-measuring circuit having an output signal indicating the current through the solenoid, the current-measuring circuit including a resistive shunt connected electrically in series with the solenoid;

and a voltage-control circuit applying a continuously adjustable voltage at a connection point between the solenoid and the current-control circuit such that the time it takes the current through the solenoid to drop from the pull-in level to the hold level is adjustable above a minimum time;

in which:

the current-control circuit includes an output transistor;

the solenoid is connected to ground over the output transistor of the current-control circuit;

the connection point is electrically connected to an output point of the output transistor;

the output signal of the current-measuring circuit forms a first input to a differencing element in the current-control circuit;

a desired current level signal forms a second input to the differencing element in the current-control circuit;

the output of the differencing element in the current-control circuit corresponds to the difference between its first and second inputs and is applied as a driving input to the output element of the current-control circuit;

the voltage-control circuit includes an output transistor;

the solenoid is connected to ground over the output transistor of the voltage-control circuit;

an output signal of the voltage-measuring circuit, which is also the signal applied at the connection point, forms a first input to a differencing element in the voltage-control circuit;

a desired voltage level signal forms a second input to the differencing element in the voltage-control circuit; and the output of the differencing element in the voltage-control circuit corresponds to the difference between its first and second inputs and is applied as a driving input to the output element of the voltage-control circuit.

* * * * *